US005233189A

United States Patent [19]

Wollnik

[11] Patent Number: 5,233,189

[45] Date of Patent: Aug. 3, 1993

[54] TIME-OF-FLIGHT MASS SPECTROMETER AS THE SECOND STAGE FOR A TANDEM MASS SPECTROMETER

[76] Inventor: Hermann Wollnik, Auf der Platte 30, 6301 Fernwald 2, Fed. Rep. of Germany

[21] Appl. No.: 844,830

[22] Filed: Mar. 3, 1992

[30] Foreign Application Priority Data

Apr. 3, 1991 [DE] Fed. Rep. of Germany ..... 4106796

[51] Int. Cl.[5] ..... H01J 49/40

[52] U.S. Cl. ..... 250/287; 250/281

[58] Field of Search ..... 250/287, 281, 282

[56] References Cited

U.S. PATENT DOCUMENTS

| | | | |
|---|---|---|---|
| 4,694,168 | 9/1987 | Le Beyer et al. | 250/287 |
| 5,032,722 | 7/1991 | Boesl et al. | 250/287 |
| 5,073,713 | 12/1991 | Smith et al. | 250/287 |

FOREIGN PATENT DOCUMENTS

| | | | |
|---|---|---|---|
| 58612 | 6/1977 | Fed. Rep. of Germany | 250/287 |
| 51736 | 10/1980 | Japan | 250/287 |
| 1257608 | 9/1976 | Netherlands | 250/287 |
| 53152 | 8/1972 | United Kingdom | 250/287 |

OTHER PUBLICATIONS

D. Hamilton et al., *Rev. Sci. Instrum.* 61, 3104 (1990).

C. Schoppmann et al., *Int. J. Mass Spectrom. and Ion Proc.* 96, 223 (1990).

E. Dietz et al. et al., *Nucl, Instrum. and Meth.* 97, 581 (1971).

R. Heil et al., *Nucl. Instrum. and Meth.* A239, 545 (1985).

R. Schey and R. Cooks, *International Journal of Mass Spectrometry and Ion Processes* 77, 49–61 (1987).

R. Schey and R. Cooks, *International Journal of Mass Spectrometry and Ion Processes* 94, 1–14 (1989).

*Primary Examiner*—Paul M. Dzierzynski

*Assistant Examiner*—Kiet T. Nguyen

*Attorney, Agent, or Firm*—Bell, Seltzer, Park & Gibson

[57] ABSTRACT

A time-of-flight mass spectrometer is disclosed that can be used as the second stage of a tandem mass spectrometer, a so called MS-MS system, for the mass analysis of molecule fragment ions. In this system it is foreseen that the precursor-molecule ion of a particular mass is fractionated in a dissociation medium where a start-time signal is formed at the time of the fractionation. The flight time in this time-of-flight mass spectrometer—and thus the masses of the molecule-fragment ions—are then determined from the arrival times of the individual fragment ions at some stop detector.

16 Claims, 2 Drawing Sheets

TIME-OF-FLIGHT MASS SPECTROMETER AS THE SECOND STAGE FOR A TANDEM MASS SPECTROMETER

BACKGROUND OF THE INVENTION

For the analysis of complex molecules one often uses tandem mass spectrometers (MS-MS systems) in which 1. the first-stage mass spectrometer separates the precursor-molecule ion from ions of different masses.
2. the precursor-molecule ions are shot into a dissociation medium (for instance a gas collision cell or a gas jet, a solid or a liquid surface or a dense cloud of electrons or ions) where these precursor molecules fractionate, usually after excitations of internal vibrations.
3. the second-stage mass spectrometer that analyzes the masses of the fragment ions (i.e., the ionized daughter molecules).

The most powerful but also most expensive MS-MS systems consist for the time being mostly of two double-focusing sector-field mass spectrometers. However, there are also very successful other combinations of systems in which quadrupole mass spectrometers but also ion traps or Fourier-transform mass spectrometers are employed. For all these second-stage systems it is very time consuming to scan through the full spectrum of the masses of the daughter molecules. In several cases sector-field mass spectrometers have therefore been equipped with some type of an "electronic photoplate" in which all ions in a certain mass range are recorded simultaneously. A problem, however, is that using a quadrupole mass spectrometer as the second-stage mass analyzer often limits one to the registering of a limited number of mass lines.

SUMMARY OF THE INVENTION

The object of the present invention is to use a time-of-flight mass spectrometer as the second-stage mass analyzer of a tandem mass spectrometer (a MS-MS system) in which the flight time of each fragment ion is determined individually by some final ion detector and in which the ion start pulse is derived from the dissociation process of the precursor molecule.

In case the first stage of a MS-MS system is a time-of-flight mass spectrometer, it is advisable to also use a time-of-flight mass spectrometer as the second-stage mass analyzer, since all precursor molecule ions of one mass (after eliminating all ions of different masses) are impacted on or in the dissociation medium at the same time. Consequently, the arrival times of the fragment ions in the second-stage time-of-flight mass spectrometer can also be recorded relative to the start time of the precursor-molecule ion in the first-stage time-of-flight mass spectrometer.

A time-of-flight mass spectrometer can, however, also be used advantageously if the first-stage mass spectrometer is a single or double focusing sector-field mass spectrometer, a quadrupole mass spectrometer, or another mass analyzer if the exact time of the dissociation of the precursor-molecule can be determined. This is possible for precursor molecules that arrive continuously at or in the dissociation medium if the electrons, light quanta or other molecule fragments formed in the dissociation process characterize the time of the dissociation process. A side condition here is only that the number of precursor-molecule ions can not be higher than the number of possible mass spectra that could be recorded in the time-of-flight mass spectrometer in question. In case of maximal flight times of 100 μsec in this time-of-flight mass spectrometer, thus maximally ≈10,000 precursor-molecule ions can be fractionated, which is quite a high number of precursor-molecules.

DETAILED DESCRIPTION OF THE PREFERRED EMBODIMENTS

Figure 1:
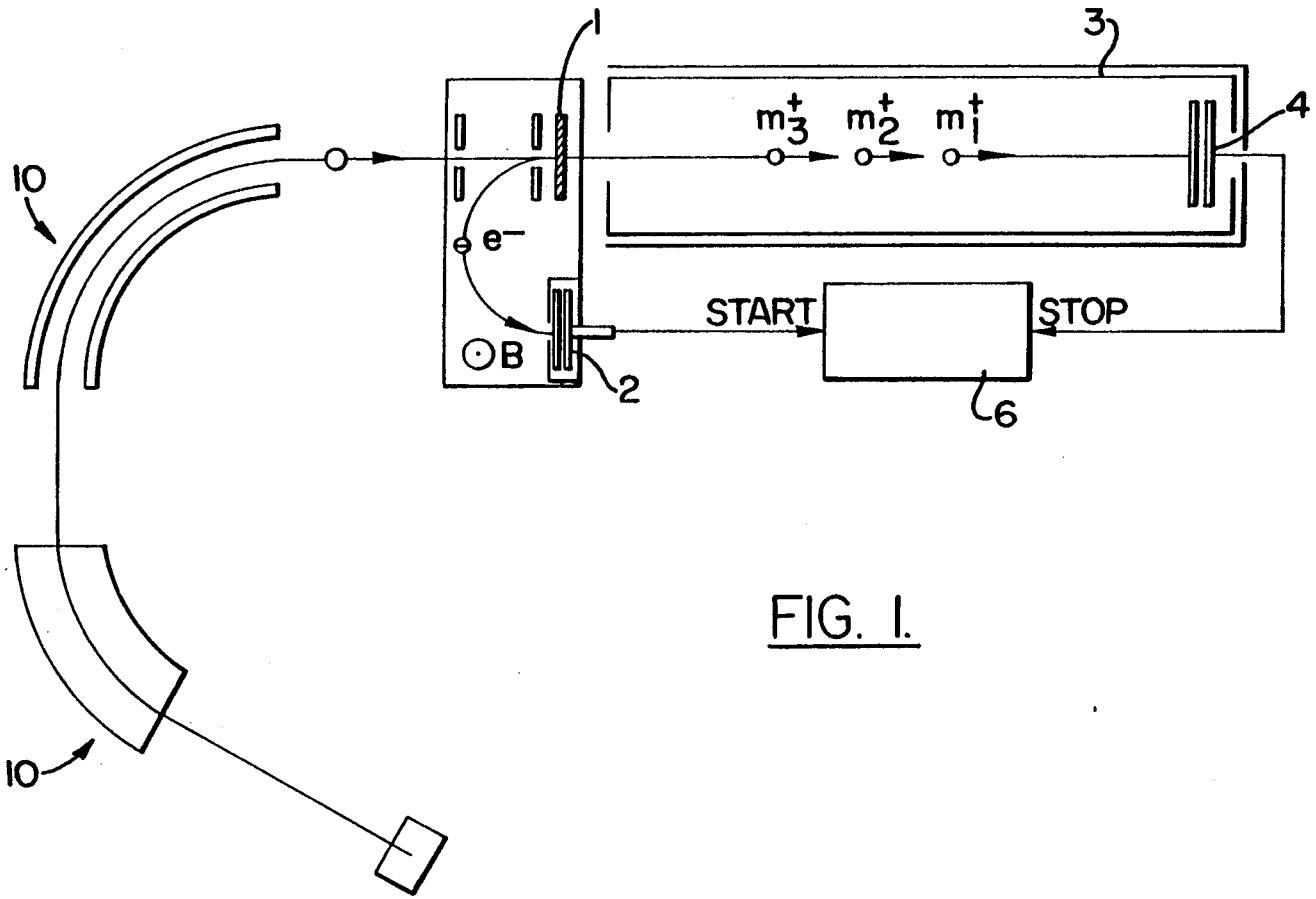
FIG. 1 shows a schematic MS-MS system consisting of a first-stage mass analyzer built as a double-focusing sector field system and a second-stage mass analyzer built as a linear time-of-flight mass spectrometer.

In overview, a second-stage mass spectrometer for the mass analysis of ionized fragments of mass-selected precursor molecules, comprises a time-of-flight mass spectrometer; ion start pulse means connected to the time-of-flight mass spectrometer for deriving the ion-start pulse from the dissociation process of the precursor molecule; and stop pulse means connected to the time-of-flight mass spectrometer for deriving a stop pulse from the arrival of the daughter molecule or molecules on an ion detector positioned after a predetermined ion flight path. The apparatus may further comprise an ion mirror positioned in the ion flight path, wherein faster ions of higher energy penetrate deeper into the ion mirror and consequently move along longer paths, so that the ion flight times of molecular fragment ions depend only on their mass-to-charge ratios and not on their energy spread.

In one embodiment the apparatus includes a dissociation medium, wherein the precursor-molecule ions of different masses arrive displaced and in which all precursor molecules cause start pulses by their dissociation processes in the dissociation medium, and wherein the mass spectra of the daughter molecules are correlated to the corresponding precursor molecules by the impact position of the precursor or the daughter molecule ions on the dissociation medium.

In another embodiment the apparatus includes a dissociation medium, wherein precursor-molecule ions of different masses arrive displaced on said dissociation medium, all precursor molecules cause start pulses by their dissociation processes in the dissociation medium, and the mass spectra of the daughter molecules are correlated to the corresponding precursor molecules by a correlation between the arrival times of the precursor-molecule ions and the formed pulses of the daughter-molecule ions.

In one embodiment, the fractionation of the precursor-molecule may occur in a gas cell or a gas jet, and the point in time of the molecule-dissociation process may be characterized by the secondary electrons or light quanta formed therein.

In another embodiment, the precursor-molecule dissociates during the impact on a solid state surface and the point in time of the molecule-dissociation process may be characterized by the formed secondary electrons or light quanta.

In still another embodiment, the precursor molecule dissociates during impact on the inner walls of channels of a micro-channel plate, and the point in time of the molecule-dissociation process is characterized by the formed light quanta or by secondary electrons that are extracted from the channels opposite to the direction of positively charged daughter ions and in the direction of negatively charged daughter ions.

Secondary electrons may be deflected by electrostatic or magnetic fields and impacted on a single or double channel plate for amplification.

In another embodiment, the secondary electrons may be deflected by electrostatic or magnetic fields and, by using an intermediate single or double channel plate for amplification, are then impacted on a scintillation screen followed by a photomultiplier.

In other embodiments, the moment of the molecule dissociation may be characterized by the arrival of a neutral daughter-molecule on a separate detector placed in forward direction, where the neutral daughter molecule (independent of acceleration fields) moves with the velocity of the precursor-molecule ion while all daughter-molecule ions are either deflected directly after their formation or are separated from the neutral daughter-molecules in the ion mirror of the time-off-light mass spectrometer.

A particular MS-MS system is built as shown in FIG. 1. The first-stage mass spectrometer is here a double-focusing sector-field mass spectrometer (10). Precursor-molecule ions of one mass impinge on the dissociation medium (1), where they fragment into daughter molecule ions and simultaneously form electrons (or photons) that characterize the start time of the daughter ions in the start detector (2). After an appropriate post acceleration (for instance by fixing the potential of the housing (3) of the time-of-flight mass spectrometer) the ions move with different velocities and consequently—depending on their masses—arrive at different times at the stop detector (4). Information about the start and stop times is recorded by a data acquisition unit (6) (as shown), such as a timing device or computer.

Figure 2:
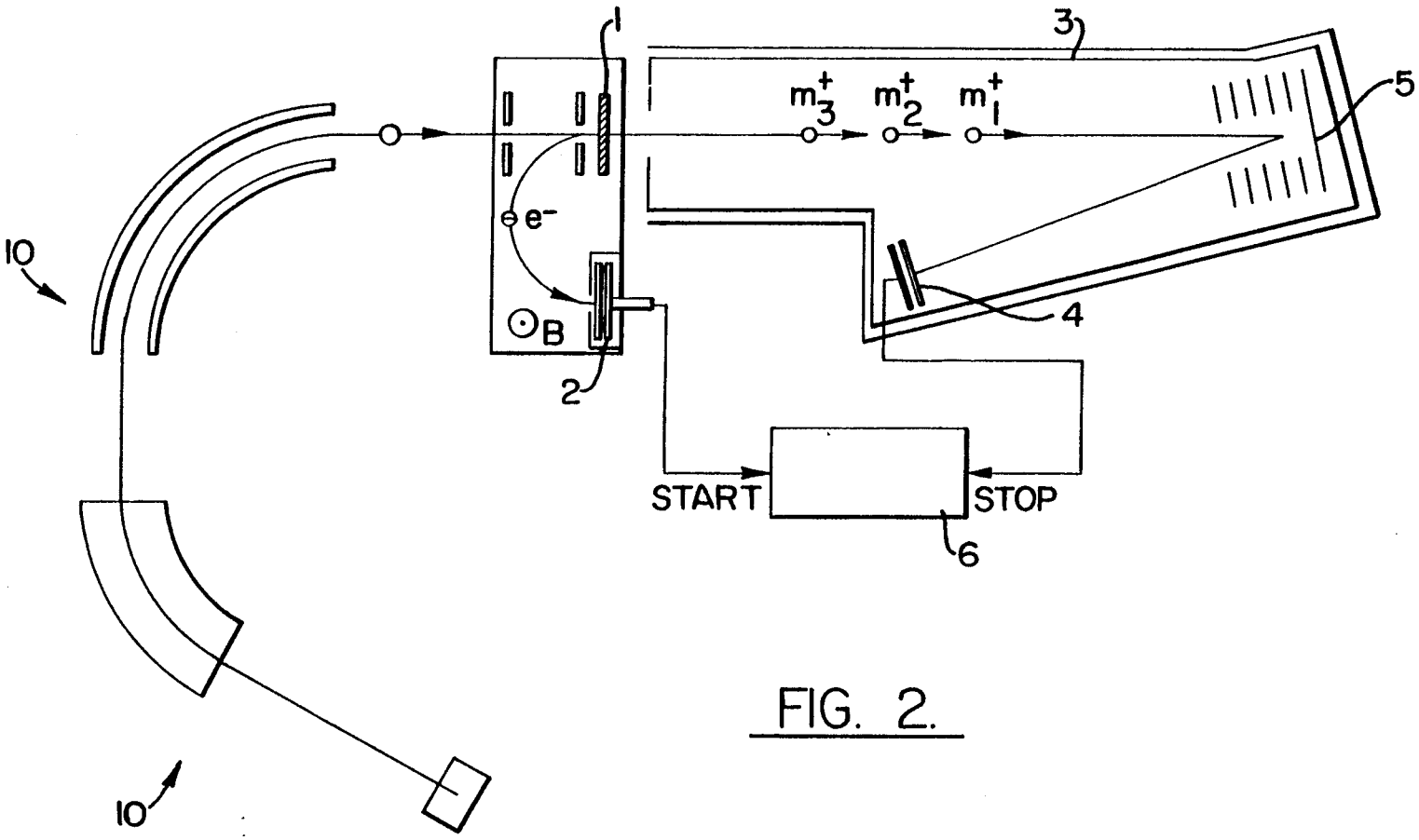
FIG. 2 shows a schematic MS-MS system consisting of a first-stage mass analyzer built as a double-focusing sector field system and a second-stage mass analyzer built as a time-of-flight mass spectrometer that uses an ion mirror which makes the ion flight times in the time-of-flight system independent of the energy spread of the ions.

In case the energy spread of the ions should deteriorate the mass determination too much, one can replace the time-of-flight mass spectrometer of FIG. 1 by one as shown in FIG. 2., which includes an ion mirror (5), and in which the ion flight time depends only on the ion mass because ions of higher energy, that move faster, penetrate deeper into the ion mirror and thus move on longer overall flight paths. Naturally also several such time-of-flight mass spectrometers could be arranged in series so that the ion beam would be deflected several times in a number of ion mirrors. Again, a data acquisition unit (6) such as that described and exemplified above records ion start and stop times.

In most cases one wishes to analyze precursor-molecule ions of not only one, but of several masses. In case one here thinks of precursor-molecule ions of two neighboring masses that can be shot onto or into the dissociation medium (1) of FIG. 1 with the same setting of the first-stage mass spectrometer, one can record all daughter-molecule ions in parallel where the two daughter-molecule spectra would be superimposed. However, the two spectra also could be recorded separately if the start detector (2) of FIG. 2 not only provides information as to when, but also provides information as to where the precursor-molecule ion impacted on the dissociation medium.

The foregoing is illustrative of the present invention, and not to be construed as limiting thereof. The invention is defined by the following claims, with equivalents of the claims to be included therein.

That which is claimed is:

1. A second-stage mass spectrometer for the mass analysis of ionized fragments of mass-selected precursor molecules, comprising:

a time-of-flight mass spectrometer having an ion detector positioned after a predetermined ion flight path;

dissociation means for generating at least one ionized fragment from a precursor molecule;

ion start pulse means connected to said time-of-flight mass spectrometer and associated with said dissociation means for deriving the ion-start pulse from the dissociation process of the precursor molecule ions; and stop pulse means connected to said time-of-flight mass spectrometer for deriving a stop pulse from the arrival of the daughter molecule or molecules on said ion detector.

2. A second-stage mass spectrometer according to claim 1, further comprising an ion mirror positioned in said ion flight path, and wherein ions of higher energy penetrate deeper into said ion mirror and consequently move along longer paths, so that the ion flight times of molecular fragment ions depend only on their mass-to-charge ratios and not on their energy spread.

3. A second-stage mass spectrometer according to claim 1, further comprising a dissociation medium, wherein the precursor-molecule ions of different masses arrive displaced on said dissociation medium, wherein all precursor molecules cause start pulses by their dissociation processes in said dissociation medium, and wherein the mass spectra of the daughter molecules are correlated to the corresponding precursor molecules by the impact position of the precursor molecule ions on said dissociation medium or the daughter molecule ions on said detector.

4. A second-stage mass spectrometer according to claim 1, further comprising a dissociation medium, wherein precursor-molecule ions of different masses arrive displaced on said dissociation medium, wherein all precursor molecules cause start pulses by their dissociation processes in said dissociation medium, and wherein the mass spectra of the daughter molecules are correlated to the corresponding precursor molecules by a correlation between the arrival times of the precursor-molecule ions and the formed pulses of the daughter-molecule ions.

5. A second-stage mass spectrometer according to claim 1, wherein the fractionation of the precursor-molecule occurs in a gas cell or a gas jet, and wherein the point in time of the molecule-dissociation process is characterized by the secondary electrons or light quanta formed therein.

6. A second-stage mass spectrometer according to claim 1, wherein the precursor-molecule dissociates during the impact on a solid state surface and the point in time of the molecule-dissociation process is characterized by the formed secondary electrons or light quanta.

7. A second-stage mass spectrometer according to claim 1, wherein the precursor-molecule dissociates during the impact on the inner walls of channels of a micro-channel plate and the point in time of the molecule-dissociation process is characterized by the formed light quanta or by secondary electrons that are extracted from the channels opposite to the direction of the positively charged daughter ions and in the direction of negatively charged daughter ions.

8. A second-stage mass spectrometer according to claim 5, 6 or 7, wherein the secondary electrons are deflected by electrostatic or magnetic fields and are impacted on a single or double channel plate for amplification.

9. A second-stage mass spectrometer according to claim 5, 6, or 7, wherein the secondary electrons are deflected by electrostatic or magnetic fields and—possible by using an intermediate amplifying single or double channel plate—are impacted on a scintillation screen followed by a photomultiplier.

10. A second-stage mass spectrometer according to claim 5, 6 or 7, wherein the moment of the molecule dissociation is characterized by the arrival of a neutral daughter-molecule on a separate detector placed in forward direction, where the neutral daughter molecule—independent of acceleration fields—moves with the velocity of the precursor-molecule ion while all daughter-molecule ions are either deflected directly after their formation or are separated from the neutral daughter-molecules in the ion mirror of the time-of-flight mass spectrometer.

11. A two stage mass spectrometer, comprising:

a first stage mass spectrometer for generating precursor molecules; and a second stage time-of-flight mass spectrometer operatively associated with said first stage mass spectrometer for receiving said precursor molecules; said second stage mass spectrometer further comprising:

dissociation means for generating at least one daughter molecule from a precursor molecule;

a start detector operatively associated with said dissociation means;

a housing connected to said dissociation means and defining an elongate flight path;

a stop detector connected to said housing and positioned downstream from said start detector;

start pulse generating means connected to said start detector for producing a start pulse from the dissociation processes of said precursor molecule in said dissociation medium; and stop pulse generating means connected to said stop detector for producing a stop pulse from the arrival of said at least one daughter molecule at said stop detector.

12. A two stage mass spectrometer according to claim 11, wherein said spectrometer is configured so that precursor molecule ions of different masses arrive displaced in location at said dissociation medium.

13. A two stage mass spectrometer according to claim 12, wherein the mass spectra of said at least one daughter molecule is correlated to the mass spectra of said corresponding precursor molecule by the impact location of said precursor molecule at said dissociation medium.

14. A two stage mass spectrometer according to claim 12, wherein the mass spectra of said at least one daughter molecule is correlated to the mass spectra of said corresponding precursor molecule by the impact position of said at least one daughter molecule.

15. A two stage mass spectrometer according to claim 12, wherein the mass spectra of said at least one daughter molecule is correlated to the mass spectra of said corresponding precursor molecule by a correlation between said start pulses and said stop pulses.

16. A two stage mass spectrometer according to claim 11, further comprising an ion mirror connected to said housing and positioned in said flight path, said ion mirror positioned so that ions of higher energy penetrate more deeply therein and move along longer paths, that the ion flight time of said at least one daughter molecule depends on mass-to-charge ratio and not on energy spread.

* * * * *